US006094883A

United States Patent [19]

Atkins

[11] Patent Number: 6,094,883

[45] Date of Patent: Aug. 1, 2000

[54] SAFETY BARRIER FOR ROOF CONSTRUCTION

[76] Inventor: Dennis P. Atkins, 2400 Castle Dr., Independence, Mo. 64057

[21] Appl. No.: 08/883,916

[22] Filed: Jun. 27, 1997

[51] Int. Cl.[7] ..... E04B 7/00

[52] U.S. Cl. ..... 52/746.11; 52/407.3; 52/745.05; 52/748.1; 156/71

[58] Field of Search ..... 52/404.1, 404.3, 52/407.3, 408, 409, 410, 411, 742.1, 745.05, 746.1, 746.11, 748.1; 156/71

[56] References Cited

U.S. PATENT DOCUMENTS

| | | | |
|---|---|---|---|
| 4,233,791 | 11/1980 | Kuhl et al. | 52/404.3 X |
| 4,375,741 | 3/1983 | Paliwoda | 52/404.3 X |
| 4,375,742 | 3/1983 | Paliwoda | 52/404.3 |
| 4,379,381 | 4/1983 | Holcombe | 52/404.3 |
| 4,391,075 | 7/1983 | Musgrave | 52/404.1 |
| 4,446,664 | 5/1984 | Harkins | 52/404.3 |
| 4,494,348 | 1/1985 | Kastelic | 52/404.4 X |
| 4,516,371 | 5/1985 | Simpson . | |
| 4,525,967 | 7/1985 | Simpson . | |
| 4,528,789 | 7/1985 | Simpson . | |
| 4,557,092 | 12/1985 | Brueske . | |
| 4,602,468 | 7/1986 | Simpson . | |
| 4,625,486 | 12/1986 | Dickinson | 52/404.1 |
| 4,635,423 | 1/1987 | Ward | 52/404.3 X |
| 4,718,211 | 1/1988 | Russell et al. . | |
| 4,875,320 | 10/1989 | Sparkes . | |
| 5,251,415 | 10/1993 | Van Auken et al. . | |

*Primary Examiner*—Carl D. Friedman
*Assistant Examiner*—Kevin D. Wilkens
*Attorney, Agent, or Firm*—Hovey, Williams, Timmons & Collins

[57] ABSTRACT

A roof covering includes a thin film safety barrier coupled between the lower flanges of spaced roof purlins for supporting the weight of a person thereon in the space between the purlins. The preferred safety barrier includes a plurality of layers with at least one of the layers being vapor impervious. In the preferred embodiment, fasteners are used to couple straps to the purlin lower flanges with the barrier therebetween in order to secure the barrier to the purlins.

14 Claims, 2 Drawing Sheets

SAFETY BARRIER FOR ROOF CONSTRUCTION

RELATED APPLICATIONS

Not applicable.

FEDERALLY SPONSORED RESEARCH OR DEVELOPMENT

Not applicable.

MICROFICHE APPENDIX

Not applicable.

BACKGROUND OF THE INVENTION

1. Field of the Invention

The present invention relates to the field of roof coverings. In particular, the invention is concerned with a thin film safety barrier coupled between the lower flanges of spaced roof purlins for supporting the weight of a person thereon in the space between the purlins.

2. Description of the Prior Art

During the construction of a building, the roof purlins and other structural members present spaces therebetween. Workers are faced with the risk of falling between the purlins while working on the roof structure during the installation of insulation and other roof coverings.

One prior art solution to this problem is to install a nonmetallic mesh fabric over the top of the purlins. This mesh fabric is strong enough to support the weight of a worker who has accidentally slipped from the purlins. The fabric also serves to support roof insulation. This prior art solution does not provide a vapor barrier in order to protect the insulation from moisture accumulation resulting in loss of insulating value. Moreover, this type of mesh does not provide an aesthetic appearance to the lower side of the roof structure, which typically remains unfinished.

In another prior art solution, insulation blankets for installation between roof purlins include safety netting. This product provides no protection for the workers installing the insulation itself and is provided in large bulky rolls of insulation material which is awkward to handle and because of this, presents an increased risk of accidents.

SUMMARY OF THE INVENTION

The present invention solves the prior art problems discussed above and presents a distinct advance in the state of the art. In particular, the roof barrier system hereof prevents workers from falling between roof purlins, presents an effective vapor barrier and provides an aesthetically attractive appearance.

The preferred roof barrier system includes a thin film safety barrier coupled adjacent the lower flanges of the roof purlins of a building. The preferred barrier includes a plurality of layers with at least one of the layers being vapor impervious and with the layers being bonded to present a unitary structure. Straps are fastened to the purlin lower flanges with the barrier therebetween for cooperatively presenting means for holding the weight of a person on the barrier in the space between the purlins.

The preferred barrier presents a light colored appearance in order to improve the aesthetic appearance of the roof as viewed from the interior of the building and to improve interior lighting reflection. Insulation can then be placed on the barrier between the purlins in order to lower the roof profile. Preferably the barrier is installed from ground level using lifts in order to eliminate the risk of workers falling between the purlins during roof construction. Other preferred aspects of the invention are disclosed herein.

DETAILED DESCRIPTION OF THE PREFERRED EMBODIMENT

Figure 1:
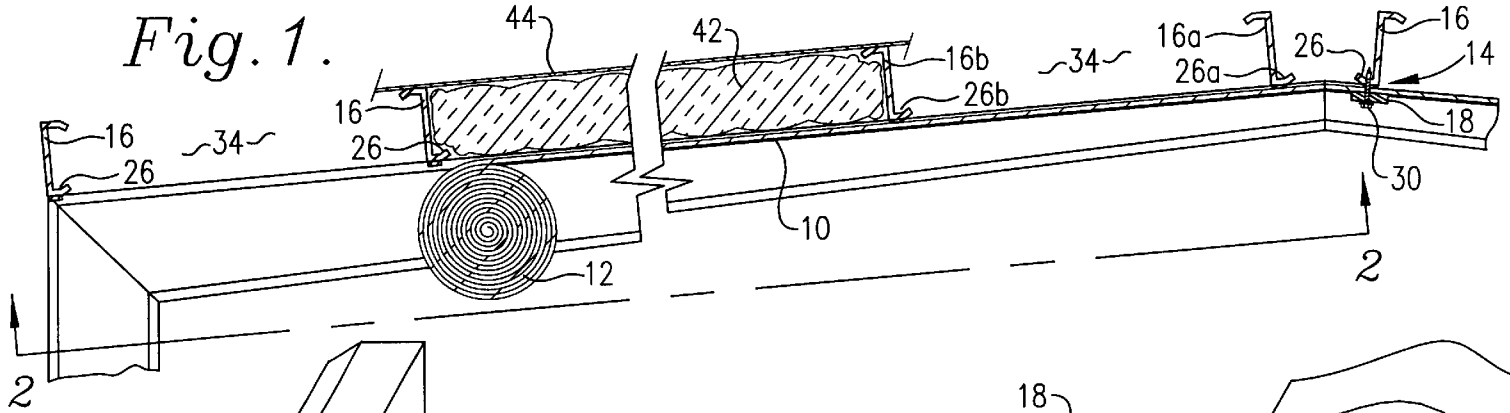
FIG. 1 is a partial sectional view of a roof structure illustrating the installation of the preferred safety barrier in accordance with the present invention.

FIG. 1 illustrates preferred safety barrier 10 being installed from a roll 12 thereof to a building roof 14 having a plurality of roof purlins 16. As used herein, the term purlins also includes other roof structural members such as beams and joists.

Barrier 10 is preferably a thin film material having a plurality of layers with at least one of the layers being vapor impervious sufficient to provide a roof vapor barrier. Preferred barrier 10 also presents a light color such as white or off-white and has sufficient strength to support the weight of a person when securely attached to roof purlins 16, as described further herein. In particular, barrier 10 presents a minimum bursting strength of 50 pounds per square inch.

Figure 4:
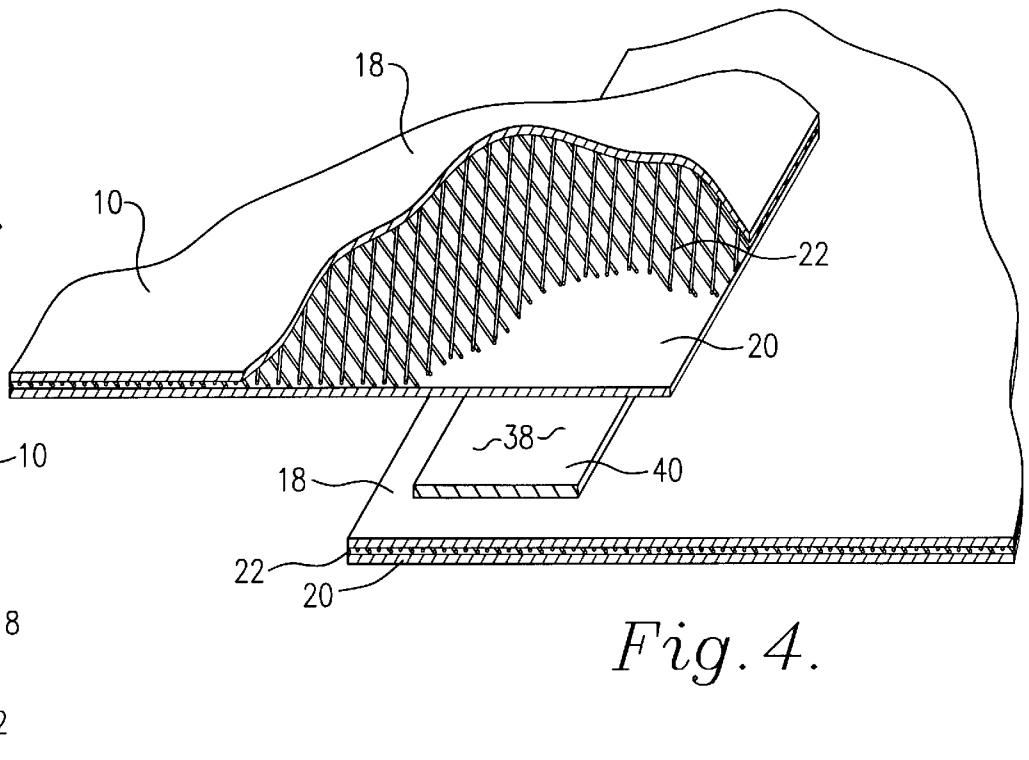
FIG. 4 is a pictorial view in partial section of the overlapped area between adjacent barriers with portions cut away for clarity of illustration.

As illustrated in the drawing figures, and in particular FIG. 4, one preferred barrier 10 includes first and second layers 18 and 20 of vinyl and metallized polyester with fiberglass scrim or mesh 22 bonded therebetween such as Lamtech Model VRP-5503. A number of other alternatives for barrier 10 are available from Lamtec Corp. such as that sold under the designation ARENASHIELD having a layer of foil and a layer of a fabric blend of fiberglass and polyester. It is also possible to alternatively utilize a barrier comprising a single layer of material that both supports a worker who has fallen between the purlins 16 and is vapor impervious. Yet another alternative barrier material includes a layer of polypropylene and a layer composed of a blend of fiberglass and polyester.

Barrier 10 is preferably installed from the interior of the building using a portable lift device in order to eliminate the risk of a worker falling between purlin 16. Initially, double face tape 24 is applied to the lower flange 26 of purlins 16. Barrier 10 is then dispensed from roll 12 in a direction transverse to purlins 16 in order to span the spaces therebetween and pressed against the exposed face of tape 24. This temporarily holds barrier 10 in place against lower flanges 26. It will be appreciated that other techniques can be used for temporarily holding barrier 10 such as contact adhesive applied to the exposed faces of lower flanges 26.

Figure 3:
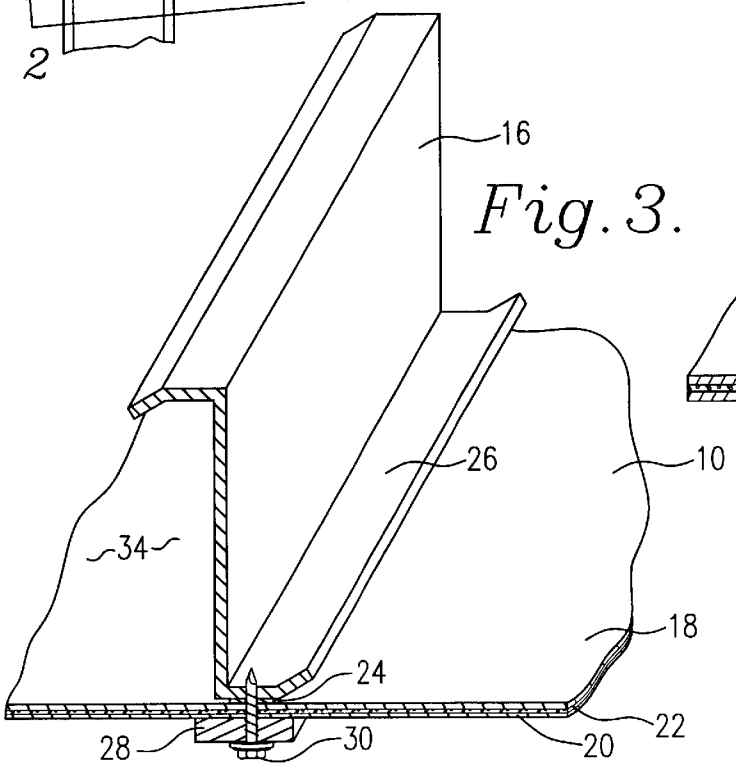
FIG. 3 is a pictorial view in partial section showing the preferred safety barrier coupled with a roof purlin.
Figure 2:
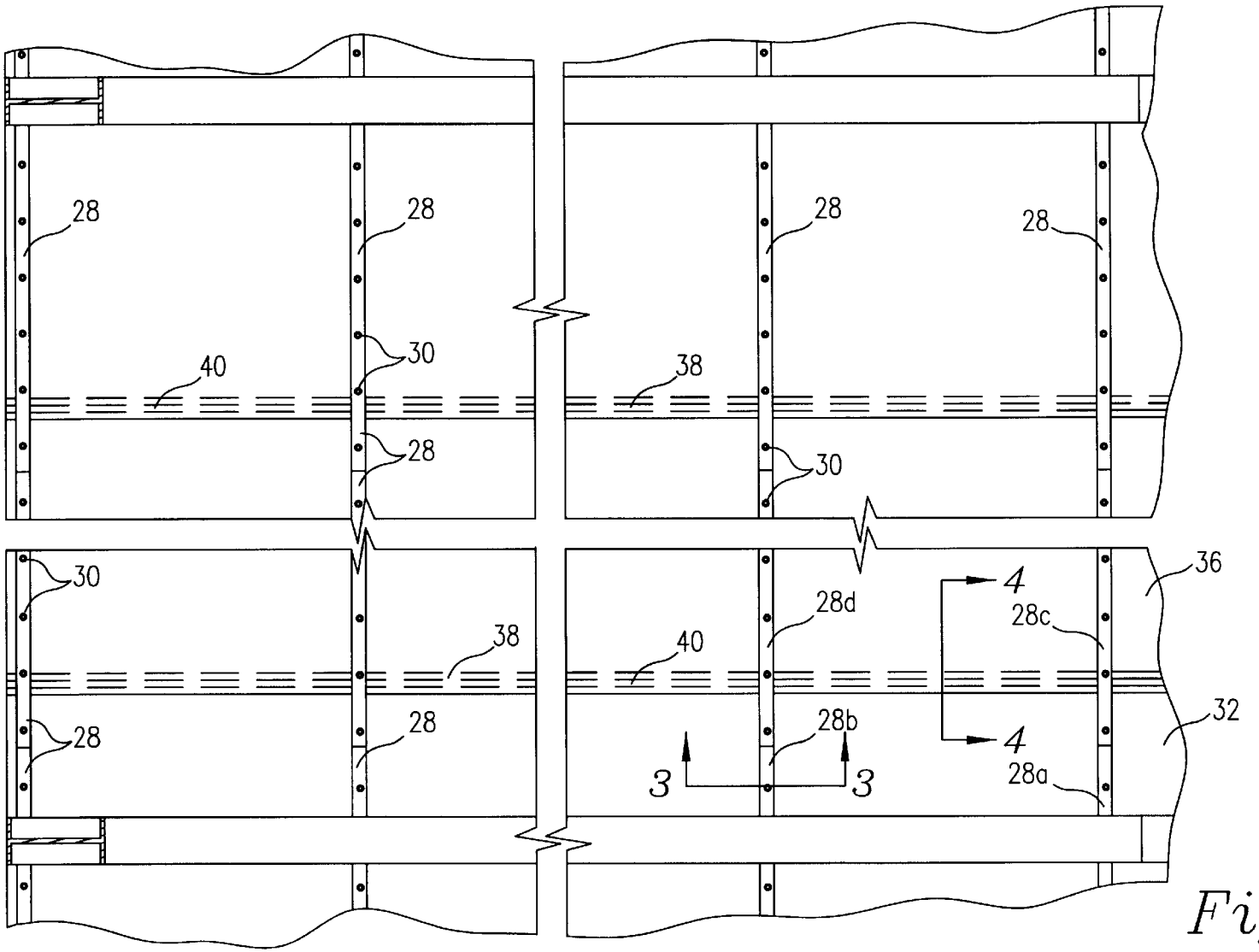
FIG. 2 is a partial lower view of the roof of FIG. 1 taken along line 2—2 of FIG. 1.

Next, straps 28 are coupled to lower flanges 26 with barrier 10 therebetween as best viewed in FIGS. 3 and 2. Straps 28 are preferably composed of metal such as aluminum and are pre-drilled for fasteners 30 which are preferably self tapping metal screws. With the strap 28 held in place against barrier 10 and against a respective lower flange 26, fasteners 30 are inserted through the holes in straps 28 and tapped into the adjacent lower flange 26.

Tape 24 remains in place and functions as a gasket to ensure uniform compression of straps 28 against barrier 10. Tape 24 also functions as a seal around fasteners 30 to ensure integrity of the vapor barrier provided by barrier 10. It will be appreciated, however, that barrier 10 can be installed without the use of tape 24 or the use of adhesive by manually holding barrier 10 in place while straps 28 are installed.

After installation of a strap such as strap 28*a* (FIG. 2) to the lower flange 26*a* of a purlin 16*a* (FIG. 1), stretch 32 of barrier 10 is pulled taut across the space 34 between purlin 16*a* and the adjacent purlin 16*b*. Strap 28*b* is then installed to secure stretch 32. This process is repeated until stretch 32 is installed across roof 14.

Next, stretch 36 of barrier 10 is installed adjacent stretch 32 and overlapped therewith to form an overlapped area 38. Double face tape 40 is used in area 38 to bond stretches 32 and 36 in order to maintain the integrity of the vapor barrier. Additional overlapped stretches of barrier 10 are installed until roof 14 is covered from the lower side against lower flanges 26.

Referring to FIG. 2, it will be noted that the lengths of straps 28*a*, 28*b* and the other straps securing stretch 32 fall short of overlapped area 38. This is necessary so that the next stretch such as stretch 36 can be installed in the overlapped relationship. After placement of stretch 36, the next set of straps such as straps 28*c* and 28*d* abut straps 28*a* and 28*b* respectively and secure overlapped area 38. This ensures secure coupling of stretches 32, 36 to one another and to flanges 26.

Those skilled in the art will now better appreciate the advantages of the present invention. Straps 28 and fasteners 30 securely couple barrier 10 to the lower flanges 26 of purlins 16 and cooperatively present means for supporting the weight of a person on barrier 10 in space 34 between purlins 16. With barrier 10 in place, installation of other roof components such as insulation 42 and sheet metal 44 can proceed without exposing the workers to injury by falling to ground level between purlins 16.

Moreover, barrier 10 provides an effective vapor barrier as well. This ensures that moisture generated within the building does not condense within insulation 42 and reduce its insulating value.

Finally, barrier 10 presents an aesthetically appealing appearance. This is especially true using the preferred light color such as white, with straps 28 and fasteners 30 painted the same. The light color also increases the efficiency of internal lighting within the building.

Those skilled in the art will also appreciate that the present invention encompasses many variations in the preferred embodiment described herein. For example, a wide variety of barrier materials can be used along with different other techniques for coupling the barrier to the purlins. Having thus described the preferred embodiments of the present invention, the following is claimed as new and desired to be secured by Letters Patent.

What is claimed is:

1. A method of covering a roof structure of a building having a plurality of side-by-side roof purlins having respective lower flanges, wherein the purlins are spaced apart and unconnected, said method comprising the steps of:

(a) placing a stretch of a flexible vapor impervious barrier adjacent the lower flanges of the purlins so that the stretch extends in a direction generally transverse to the purlins and thereby spans the space defined between adjacent purlins;

(b) securing the stretch to the purlins in such a manner that the barrier serves as a safety barrier for preventing an individual from falling through the space defined between adjacent purlins, step (b) including the steps of overlying the barrier with at least one of a plurality of elongated straps so that the at least one of the straps extends at least substantially across the stretch positioning the at least one of the straps in general alignment with the lower flange of one of the purlins fastening the at least one of the straps to the one purlin so that the stretch is secured between the lower flange and the at least one of the straps and repeating the overlying positioning and fastening steps for each of the purlins covered by the stretch; and (c) installing insulation in the space between the purlins and above said barrier therebetween.

2. The method as set forth in claim 1 further including the step of placing an exterior roof covering over the purlins.

3. The method as set forth in claim 1, step (a) further including the step of dispensing said barrier from a roll thereof.

4. The method as set forth in claim 1 including performing step (a) using said barrier with said layers including two layers of vapor impervious material with a safety mesh therebetween.

5. The method as set forth in claim 1 including performing step (a) using said barrier composed of a layer of polypropylene and a layer of foil with a fiberglass scrim bonded therebetween.

6. The method as set forth in claim 1, step (a) including the step of holding said barrier in place adjacent the lower flanges by adhering said barrier thereto prior to step (b).

7. The method as set forth in claim 6, step (a) including the step of using double face tape for holding said barrier in place adjacent the lower flanges.

8. The method as set forth in claim 1, said stretch being a first stretch, step (a) including the step of placing a second stretch of said barrier in a direction transverse to the purlins and side by side with said first stretch and overlapping a portion thereof to present an overlapped area, and repeating step (b) for said second stretch.

9. The method as set forth in claim 8, step (a) including the step of holding said barrier in place relative to the purlins by adhering said stretches to the lower flanges.

10. The method as set forth in claim 9, step (a) including the step of adhering said stretches to the lower flanges by using double face tape with one face thereof against the lower flanges and with said barrier against the other face thereof.

11. The method as set forth in claim 9, step (a) including the step of bonding said first stretch to said second stretch in said overlapped area.

12. The method as set forth in claim 11, step (a) including the step of using double face tape in said overlapped area for bonding said first stretch to said second stretch.

13. The method as set forth in claim 11, step (b) further including the step of positioning the at least one strap to overlap said overlapped area.

14. A method of covering a roof structure of a building having a plurality of side-by-side roof purlins having respective lower flanges, wherein the purlins are spaced apart and unconnected, said method comprising the steps of:

(a) placing a stretch of a flexible, vapor impervious barrier adjacent the lower flanges of the purlins so that the stretch extends in a direction generally transverse to the purlins and thereby spans the space defined between adjacent purlins;

(b) securing the stretch to the purlins in such a manner that the barrier serves as a safety barrier for preventing an individual from falling through the space defined between adjacent purlins, step (b) including the steps of overlying the barrier with at least one of a plurality of elongated straps so that the at least one of the straps extends at least substantially across the stretch, positioning the at least one of the straps in general alignment with the lower flange of one of the purlins, fastening the at least one of the straps to the one purlin so that the stretch is secured between the lower flange and the at least one of the straps, and repeating the overlying, positioning and fastening steps for each of the purlins covered by the stretch; and (c) after steps (a) and (b), installing insulation above the barrier.

* * * * *